US005347678A

United States Patent [19]

Williams et al.

[11] Patent Number: 5,347,678

[45] Date of Patent: Sep. 20, 1994

[54] HEAD ASSEMBLY FOR A VACUUM CLEANING APPARATUS HAVING DUAL-INDIVIDUALLY FLOATING HEADS

[76] Inventors: William H. Williams, 4938 Golden Arrow, Palos Verdes, Calif. 90274; Paul G. Jacobs, 9958 Amestoy Ave., Northridge, Calif. 91324

[21] Appl. No.: 136,546

[22] Filed: Oct. 14, 1993

[51] Int. Cl.[5] ..... A47L 5/30

[52] U.S. Cl. ..... 15/331; 15/354; 15/359

[58] Field of Search ..... 15/331, 354, 355, 359, 15/360

[56] References Cited

U.S. PATENT DOCUMENTS

| | | | |
|---|---|---|---|
| 1,470,894 | 10/1923 | Throop . | |
| 1,726,592 | 9/1929 | Spanel . | |
| 2,348,861 | 5/1944 | Smellie . | |
| 3,942,216 | 3/1976 | Minton | 15/331 |
| 4,167,799 | 9/1979 | Webb | 15/359 X |
| 4,179,768 | 12/1979 | Sawyer . | |
| 4,234,995 | 11/1980 | Parise | 15/359 X |
| 4,594,749 | 6/1986 | Waterman | 15/359 X |
| 4,809,397 | 3/1989 | Jacobs et al. . | |
| 4,951,346 | 8/1990 | Salmon . | |
| 4,976,003 | 12/1990 | Williams . | |
| 5,008,973 | 4/1991 | Worwag . | |
| 5,012,549 | 5/1991 | Williams et al. . | |
| 5,054,158 | 10/1991 | Williams et al. . | |
| 5,189,757 | 3/1993 | Williams et al. . | |

FOREIGN PATENT DOCUMENTS 391578 5/1933 United Kingdom .

*Primary Examiner*—Chris K. Moore

*Attorney, Agent, or Firm*—Kelly, Bauersfeld & Lowry

[57] ABSTRACT

A cleaning head assembly for a vacuum cleaning apparatus of the wet, dry and wet/dry types includes a rotatably driven brush carried within and laterally spanning the head assembly. A pair of floating vacuum heads are positioned on opposite sides of a housing for the brush, and each defines a portion of a vacuum pathway having an inlet opening adjacent to the surface to be cleaned, which extends from the inlet opening to a dirt collection zone within the vacuum cleaning apparatus. The floating vacuum heads are each attached to the brush housing in a manner permitting relative movement therebetween. In this regard, a track fixed to the brush housing engages a generally vertically extending flange extending from a vacuum head such that the flange moves within the track to control movement of the vacuum head relative to the brush housing. A roller spaces the flange from the track to minimize frictional contact therebetween, and a stop pin limits relative movement between the vacuum head and the track. A spring is provided to bias the vacuum head downwardly to place the inlet opening adjacent to the surface to be cleaned.

29 Claims, 3 Drawing Sheets

HEAD ASSEMBLY FOR A VACUUM CLEANING APPARATUS HAVING DUAL-INDIVIDUALLY FLOATING HEADS

BACKGROUND OF THE INVENTION

This invention relates generality to cleaning devices. More specifically, the present invention relates to an improved cleaning head assembly for a vacuum cleaning apparatus of the wet, dry and wet/dry types.

Many prior devices for cleaning rugs, carpets and the like have consisted basically of a system for delivering cleaning solution (usually a hot aqueous detergent solution) to the rug or carpet, and a system for vacuuming the applied cleaning solution from the rug or carpet. Many such "vacuum cleaners" or carpet cleaning machines have been provided with a rotatable brush which is intended to contact and brush the surface to be cleaned, to loosen and agitate dirt, grit and debris so that it can be sucked up into a collection tank or bag by a vacuum motor. The brush is able to perform its intended purpose only to the extent the distal ends of the bristles of the brush are in contact with the surface being cleaned. Keeping the brush in contact is not a problem provided the surface being cleaned is absolutely uniform, smooth and level. However, in most cases, the surface is irregular or bumpy. When this irregular surface condition exists, the efficiency of the brush is diminished, since only some of the bristles can contact the surface being cleaned. One of the best devices for maintaining contact between the brush and the surfaces being cleaned where the surface is irregular is shown in U.S. Pat. No. 4,976,003, entitled CLEANING APPARATUS, and issued to one of the inventors herein.

A typical vacuum system for a carpet cleaning device generally comprises a vacuum chamber or nozzle disposed in a cleaning head assembly which is positioned over the rug, carpet or the like to "suck up" applied cleaning solution, dirt and other debris, and a vacuum pump in fluid communication with the cleaning head assembly to generate a partial vacuum therein. There are two variations of the basic system found in the marketplace. In one embodiment, the cleaning head, the solution delivery system, the vacuum system, and one or more solution tanks are integrated into a single wheeled housing which is pulled over the rug or carpet by the operator. In the other embodiment, the cleaning head is a separate unit from a wheeled housing containing the vacuum system, the solution delivery system and the solution tanks. Both embodiments have advantages and disadvantages. For example, the cleaning unit having a separate cleaning head is easier to manipulate over a rug or carpet surface, but because of the additional distance the fresh solution must be pumped to the cleaning head and the spent solution must be transferred back to the housing after the aspiration thereof from the rug or carpet, the power requirements for both the solution pump and the vacuum pump are substantially increased. Moreover, the connections for the tubings for the separate cleaning head present maintenance problems because they frequently leak solution.

The cleaning devices which are completely contained within a wheeled housing are most desirable from a manufacturing and maintenance point of view, but they are more difficult to move over a rug or carpet surface during the cleaning operation, especially where space is limited, for example in small offices or narrow hallways. As a result, their use was traditionally limited to professional or commercial rug and carpet cleaners. A significant advancement in the construction of such cleaning devices is shown in U.S. Pat. No. 5,189,757, entitled HEAD ASSEMBLY FOR A VACUUM CLEANING APPARATUS.

In spite of numerous improvements in the design of prior cleaning devices, optimal performance has not yet been realized, particularly where the surface to be cleaned is irregular or bumpy. In order to "suck up" applied cleaning solution, dirt and other debris, it is important to maintain an inlet of a vacuum head in close intimate contact with the floor surface. This is particularly difficult to accomplish with cleaning devices which are completely contained within a wheel housing.

Accordingly, there has been a need for a novel vacuum cleaning apparatus of the wet, dry and wet/dry types having a proven, durable construction, which can be easily maneuvered over a surface to be cleaned during the cleaning operation, and is constructed in a manner which ensures that inlet openings of the vacuum head are placed adjacent to the surface to be cleaned, even when the surface is irregular of bumpy. Such a novel vacuum cleaning apparatus may include heads which are permitted to follow the contour of the surface to be cleaned independently of a supporting housing. Further, there exists a need for a novel cleaning head assembly for use in a vacuum cleaning apparatus which permits the apparatus to be either pushed or pulled, and yet provide means for adequately sucking up debris loosened by the cleaning brush without reducing the vacuum drawn through the cleaning head. The present invention fulfills these needs and provides other related advantages.

SUMMARY OF THE INVENTION

The present invention resides in an improved cleaning head assembly for a vacuum cleaning apparatus, which ensures uniform cleaning of that surface and also beneficially assists in propulsion of the cleaning apparatus across the surface to be cleaned. The improved cleaning head assembly is useful in industrial vacuum cleaners wherein the cleaning head and the vacuum system are integrated into a single wheeled housing which is pulled over a rug, carpet or other surface to be cleaned by the operator. The head assembly of the present invention is particularly useful when such industrial units are utilized to clean irregular or bumpy surfaces. The cleaning head assembly comprises, generally, a stationary support within the vacuum cleaning apparatus, and a floating vacuum head which is positioned adjacent to the stationary support. The floating vacuum head is provided means for attaching the vacuum head to the stationary support in a manner permitting relative movement therebetween.

In a preferred form of the invention, the cleaning head assembly comprises a rotatably driven brush carried within and laterally spanning the head assembly, which brush is adapted to loosen and agitate dirt on a surface to be cleaned. A first floating vacuum head is provided which is vertically movable, free-floating and self-aligning relative to a housing for the brush. The first floating vacuum head defines a portion of a first vacuum pathway having a first inlet opening adjacent to the surface to be cleaned, and laterally spans the head assembly on one side of the brush. The first vacuum pathway extends from the first inlet opening to a dirt collection zone within the vacuum cleaning apparatus.

A second floating vacuum head is provided which is vertically movable, free-floating and self-aligning relative to the housing for the brush. The second floating vacuum heads defines a portion of a second vacuum pathway which has a second inlet opening adjacent to the surface to be cleaned and laterally spans the head assembly on a second, opposite side of the brush relative to the first inlet opening. The second vacuum pathway extends from the second inlet opening to the dirt collection zone within the vacuum cleaning apparatus.

The floating vacuum heads each include means for attaching the vacuum head to the brush housing in a manner permitting movement of the vacuum head relative to the brush housing. The attaching means comprises a track which is fixed to the brush housing. The track engages a generally vertically extending flange which extends from the vacuum head. The attaching means further includes means for facilitating movement of the flange within the track. The facilitating means includes a glider which is fixed with respect to the flange and which spaces the flange from the track to minimize frictional contact therebetween.

Means are provided for limiting relative movement between the vacuum head and the track. The movement limiting means includes a stop pin fixed to the track and disposed so as to fit within a channel-like groove of the flange. Means are also provided for biasing the vacuum head downwardly to place the inlet opening adjacent to the surface to be cleaned. The biasing means includes a spring extending between brackets fixed to the vacuum head and to the track.

A first vacuum chamber extends through the cleaning head assembly from the first inlet opening to a first exhaust port. A second vacuum chamber extends through the cleaning head assembly from the second inlet opening to a second exhaust port. A common vacuum passageway is connectable to the first and the second exhaust ports, and extends to the dirt collection zone to, respectively, form a portion of the first and the second vacuum pathways. At least one of the first or second vacuum chambers is defined by one of the first or second floating vacuum heads and a flexible hose extending from said floating vacuum head to a respective exhaust port.

Means are provided for selectively drawing a vacuum through the first or the second vacuum pathways. The means for selectively drawing a vacuum through the first or the second vacuum pathways includes means for selectively placing the common vacuum passageway in fluid communication with one of the first or the second vacuum heads. In this regard, a valve is provided for selectively coupling a proximal end of the common vacuum passageway to one of the first or the second exhaust ports. The valve comprises a slidable gate valve.

Further, means are provided for controlling and changing the direction of brush rotation in accordance with the vacuum pathway selected. The position of the gate valve determines the direction of brush rotation through the brush rotation controlling means.

Other features and advantages of the present invention will become apparent form the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
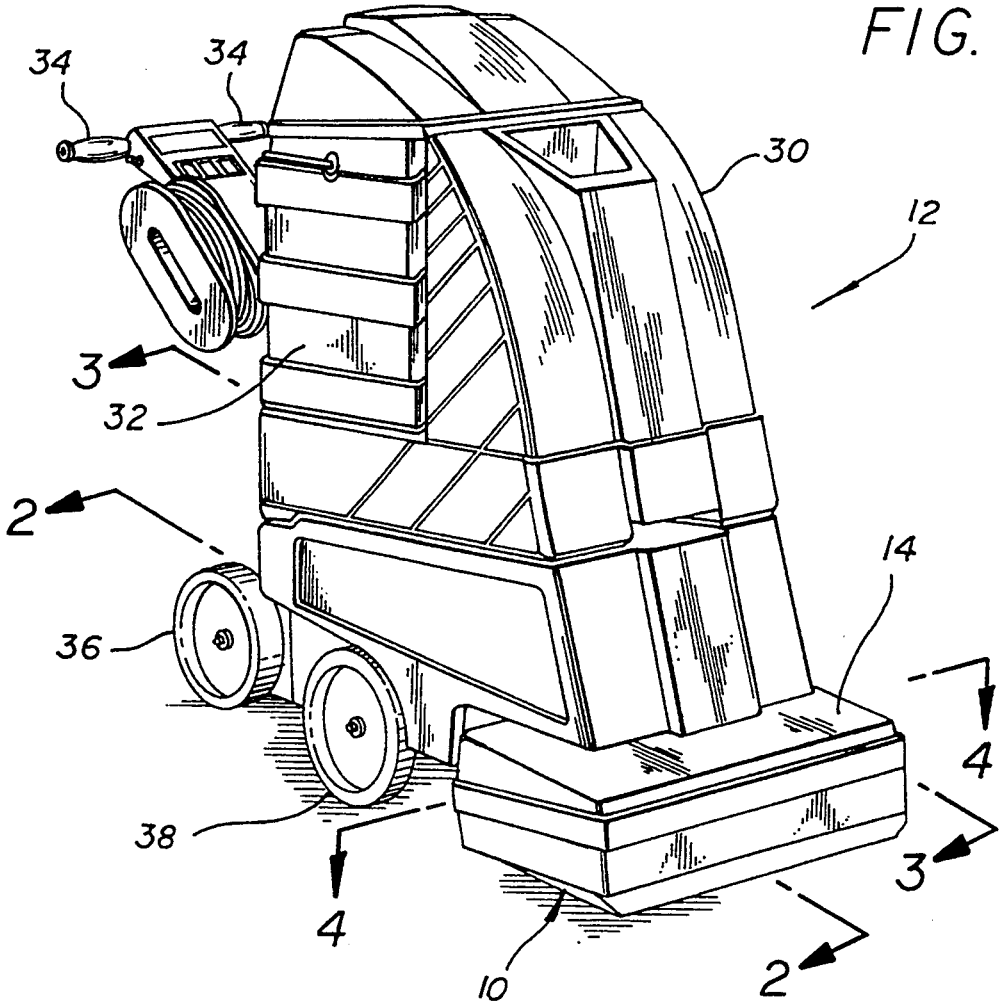
FIG. 1 is a perspective view of an exemplary vacuum cleaning apparatus having the cleaning head assembly of the present invention.

As shown in the drawings for purposes of illustration, the present invention is concerned with an improved cleaning head assembly, generally designed by the reference number 10, designed for use in connection with a vacuum cleaning apparatus 12. The cleaning head assembly 10 comprises a housing 14 and a brush 16 carried within and laterally spanning the housing. The brush 16 is adapted to loosen and agitate dirt on a surface 18 to be cleaned. Vacuum means are provided within the vacuum cleaning apparatus 12, which communicate with the cleaning head assembly 10 for sucking up debris and carrying it to a collection zone within the vacuum cleaning apparatus. The vacuum means includes a first vacuum pathway 20 having a first inlet opening 22 adjacent to the surface 18 to be cleaned and laterally spanning the head assembly 10 on one side of the brush 16. The vacuum means also includes a second vacuum pathway 24 having a second inlet opening 26 adjacent to the surface 18 to be cleaned and laterally spanning the head assembly 10 on a second, opposite, side of the brush 16 relative to the first inlet opening 22. A slidable gate valve 28 provides means for selectively drawing a vacuum through one of the first or the second vacuum pathways 20 and 24, as determined by the position of the gate valve.

In a preferred form of the invention, and with reference to FIG. 1, the vacuum cleaning apparatus 12 includes an upper body 30 which carries removable water tanks 32 and handles 34 at the top rear. The upper body 30 encloses a vacuum motor (not shown) which is carried on a frame chassis by four wheels. The rear wheels 36 are rotatably connected to the cleaning apparatus 12, but are otherwise fixed in that they cannot move up and down relative to the rest of the machine. The front wheels 38 preferably can move relative to the upper body 30. The structure of the upper portion of the cleaning apparatus 12 is more fully disclosed in U.S. Pat. No. 5,012,549, issued May 7, 1991, which is incorporated herein by reference. The structure of the chassis and wheels of the cleaning apparatus 12 is more fully disclosed in U.S. Pat. No. 5,054,158, issued Oct. 8, 1991, which is also incorporated herein by reference.

Figure 2:
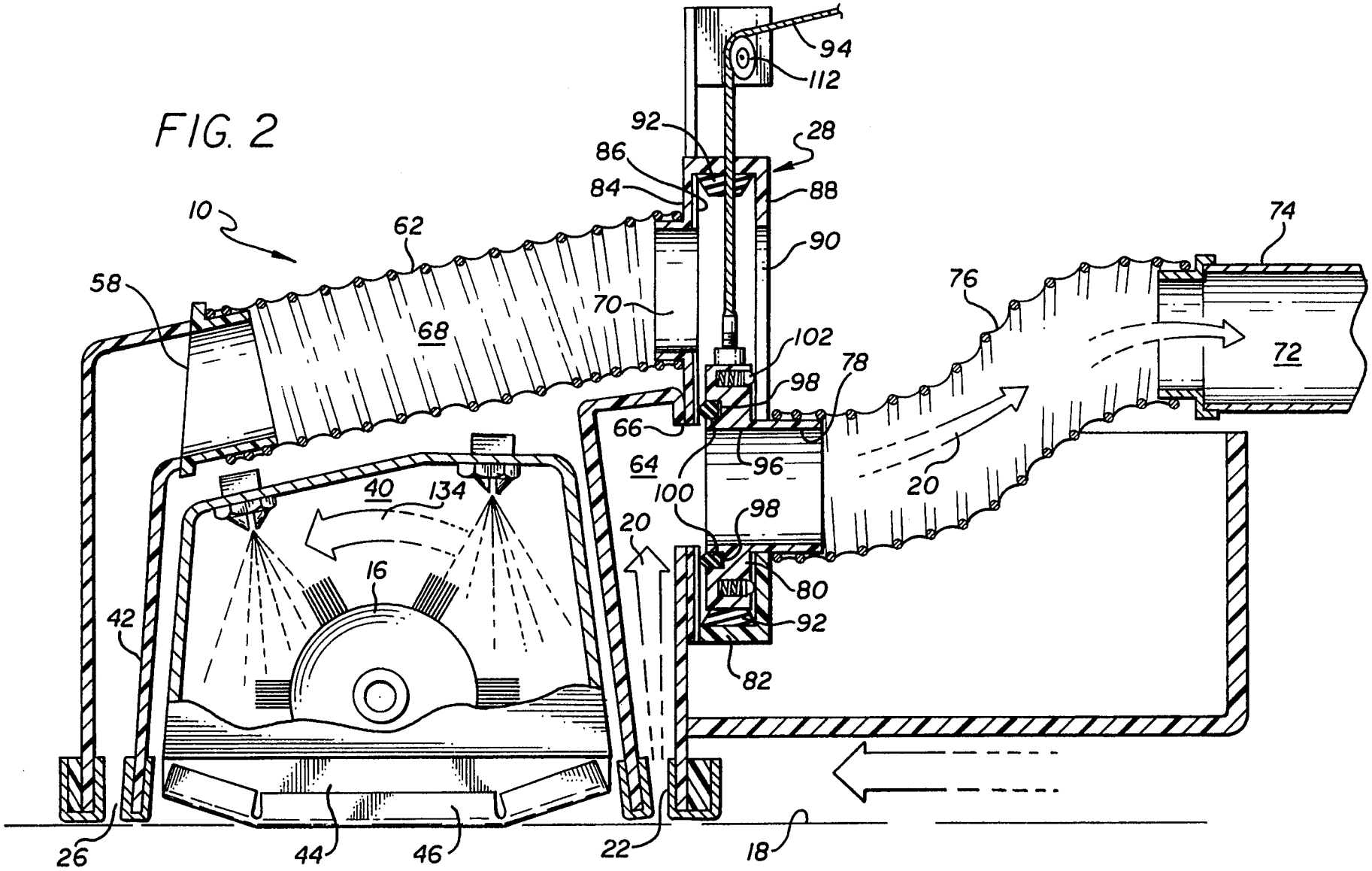
FIG. 2 is an enlarged fragmented vertical section taken generally along the line 2—2 of FIG. 1, illustrating the general components and configuration of the cleaning head assembly including dual, individually floating heads, and also showing the position of a slidable gate valve to couple a flexible hose leading to a dirt collection zone within the vacuum cleaning apparatus, to a first exhaust port to define a first vacuum pathway through the cleaning head assembly.
Figure 3:
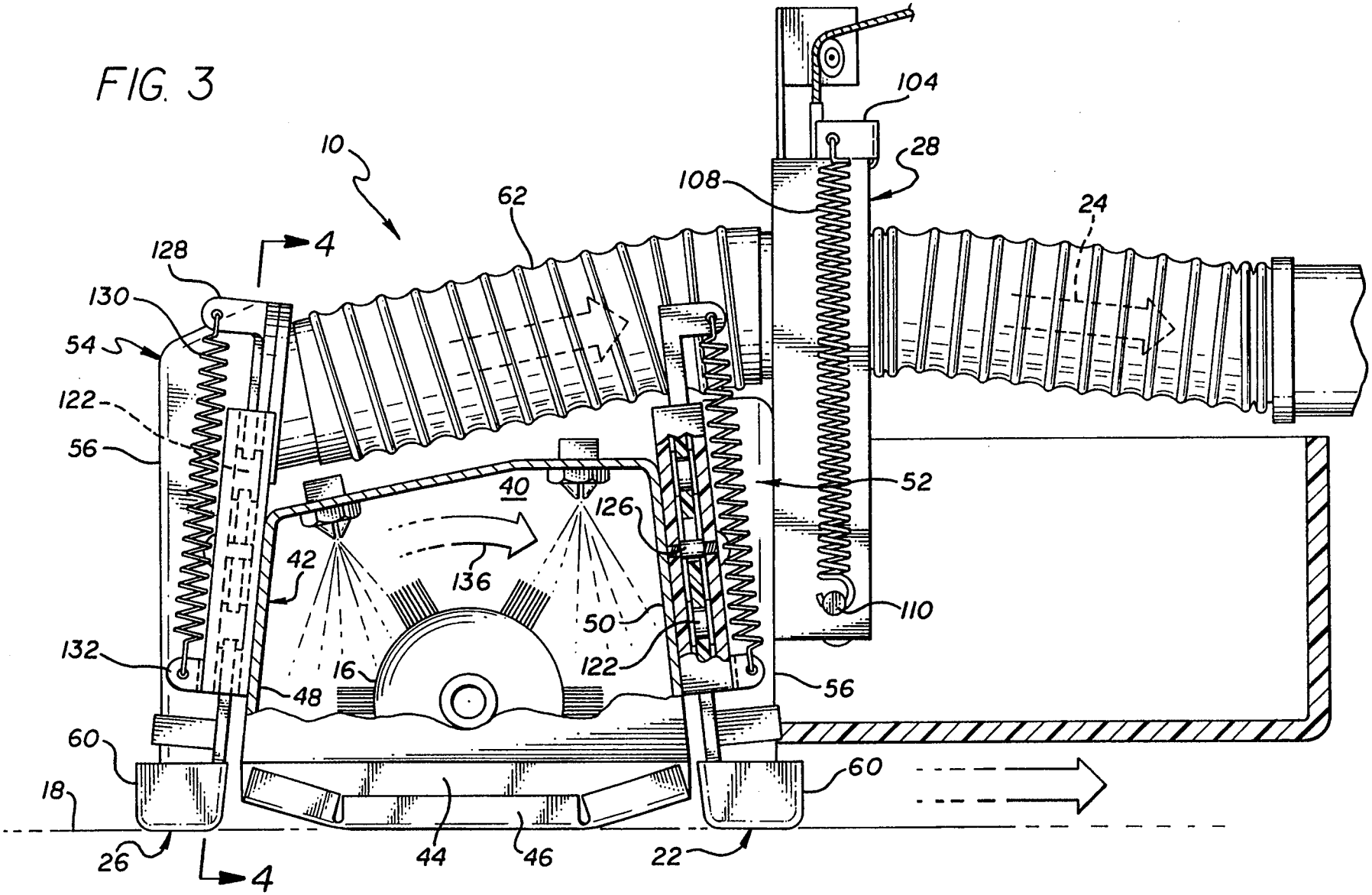
FIG. 3 is an enlarged fragmented vertical section similar to FIG. 2 and taken along the line 3—3 of FIG. 1, illustrating the construction of the floating vacuum heads, and further showing the position of the slidable gate valve to couple the flexible hose to a second exhaust port, thereby defining a second vacuum pathway through the cleaning head assembly.

The cleaning head assembly 10 extends from the front of the cleaning apparatus 12 and is normally raised up slightly from the floor surface 18 when all four wheels are resting on the floor. In use, as shown in FIGS. 1–3, the rear wheels 36 are raised off the floor 18 when the operator lifts up on the handles 34. Simultaneously, the cleaning head assembly 10 is brought down to rest on the surface 18. At this point, the weight of the vacuum cleaning apparatus 12 rests on the front wheels 38 and on the cleaning head assembly 10.

As shown in U.S. Pat. No. 5,189,757, the contents of which are incorporated herein by reference, the cleaning head assembly 10, and specifically the housing 14, has affixed thereto a pair of shaft block retainer cases in which shaft blocks are slidably received. A shaft of the brush 16 is slip-fitted into the shaft blocks. The brush 16 is rotatably carried by the shaft on ball bearings. The brush 16 is driven by a brush drive motor via a timing belt. The brush 16 has a solution slinger and string guard combinations on each end. The timing belt runs over a brush pulley and a brush motor pulley. The structure of the brush 16, the shaft blocks and related components of the cleaning head assembly 10 is more fully disclosed in U.S. Pat. No. 4,976,003, the contents of which are also incorporated herein by reference.

In accordance with the present invention, and with reference to FIGS. 2–5, the brush 16 is situated within a brush chamber 40 defined by an inner housing 42 of the cleaning head assembly 10. The inner housing 42 includes side walls 44 which provide supporting runners 46 for the cleaning head assembly 10. The runners 46 serve as the primary supporting structure for the cleaning head assembly 10 over the surface 18 to be cleaned. The front and rear walls 48 and 50 of the inner housing 42 provide stationary supports to which floating vacuum heads 52 and 54 are attached in a manner permitting relative movement therebetween.

Each of the floating vacuum heads 52 and 54 comprise a hollow rigid body 56 having an inlet opening 22 or 24 at one end thereof adjacent to the surface 18 to be cleaned, and an outlet opening 58 which is spaced from the inlet opening. The rearwardly disposed or first floating vacuum head 52 defines a portion of the first vacuum pathway, whereas the forwardly disposed or second floating vacuum head 54 defines a portion of the second vacuum pathway 24. A pair of self-lubricating caps 60 are placed over the lower ends of the bodies 56 to provide a suitable surface for engaging the surface 18 to be cleaned. Further, a flexible hose 62 extends between the outlet opening 58 of the second floating vacuum head 54 and the gate valve 28.

A first vacuum chamber 64 within the first floating vacuum head 52 is in open fluid communication with the first inlet opening 22, and defines a portion of the first vacuum pathway 20. A first exhaust port 66 corresponding to the outlet opening 58 of the first vacuum head 52 body 56, provides access to the first vacuum chamber 64 and permits the vacuum means of the vacuum cleaning apparatus 12 to be coupled to the first vacuum chamber to suck up debris through the first inlet opening 22.

A second vacuum chamber 68 defined by the second floating vacuum head 54 is in open fluid communication with the second inlet opening 26, and the flexible hose 62, and defines a portion of the second vacuum pathway 24. A second exhaust port 70 defined by an end of the flexible hose 62 opposite the second vacuum head 54, provides access to the second vacuum chamber 68 and permits the vacuum means of the vacuum cleaning apparatus 12 to be coupled to the second vacuum chamber 68 to suck up debris through the second inlet opening 26. Preferably the second exhaust port 70 is immediately adjacent to the first exhaust port 66, to permit the gate valve 28 to be selectively positioned in order to permit a partial vacuum to be drawn through either the first or the second vacuum chambers 64 and 68.

A common vacuum passageway 72 extends generally from the cleaning head assembly 10 to a dirt collection zone within the vacuum cleaning apparatus 12. As illustrated, the common vacuum passageway 72 comprises a section of piping 74 and a flexible hose 76 attached at one end to the piping 74 and at another end to a connection nipple 78 of the gate valve 28. The common vacuum passageway 72 and the first vacuum chamber 64 define the first vacuum pathway 20 extending from the first inlet opening 22, through the first exhaust port 66, to the dirt collection zone within the vacuum cleaning apparatus 12. The common vacuum passageway 72 and the second vacuum chamber 68 collectively define the second vacuum pathway 24 which extends from the second inlet opening 26, through the second exhaust port 70 to the dirt collection zone within the vacuum cleaning apparatus 12.

The gate valve 28 comprises, generally, a plate 80 slidable within a valve housing 82 fixed to a rearward wall of the first floating vacuum head 52. The slidable plate 80 is movable between a first position ( FIG. 2) in which the proximal end of the flexible hose 76 is coupled to the first exhaust port 66, and a second position (FIG. 3) in which the proximal end of the flexible hose is connected to the second exhaust port 70.

The valve housing 82 includes a front wall 84 having apertures therein corresponding to and aligned with the exhaust ports 66 and 70. The inner surface of the front wall 84 is lined with a teflon lining 86 to facilitate sliding movement of the plate 80 thereon and the formation of a seal. The valve housing 82 further includes a back wall 88 having an elongated aperture 90 through which the connection nipple 78 extends. The aperture 90 accommodates the full range of movement of the connection nipple 78 as the plate 80 is displaced between its first position and its second position. Flexibly resilient bumpers 92 are fixed to the upper and lower inner surfaces of the valve housing 82 to provide stops for the plate 80. Additionally, a gap is provided in the upper end of the valve housing 82 to permit a pull cable 94 attached to the slidable plate 80, to extend out from the valve housing 82 to a suitable valve control mechanism.

The slidable plate 80 (FIG. 5) is generally rectangular and includes a central aperture 96 defined by the connection nipple 78. A groove 98 circumscribes the central aperture 96, and a gasket 100 is positioned within the grove 98 to engage the teflon lining 86 on the front wall 84. The gasket 100 creates a seal around the central aperture 96 of the plate 80. The forward face of the plate 80, and particularly the gasket 100, is biased toward the teflon lining 86 by means of four spring loaded balls 102 which bear against the back wall 88 of the valve housing 82. Additional compressive force is exerted between the gasket 100 and the inner surface of the front wall 84 of the valve housing 82, by utilizing a wire-reinforced flexible hose 76 which is slightly compressed prior to being attached between the piping 74 and the connection nipple 78.

A bracket 104 is fixed to the top of the plate 80 and extends rearwardly through the elongated aperture 90. Two springs 108 are attached to the bracket 104 and extend downwardly therefrom on both sides of the connection nipple 78 and the flexible hose 76 to anchors 110 provided on the valve housing 82. The springs 108 bias the slidable plate 80 into its first position, thus requiring forcible displacement of the plate from the first position to a second position.

In order to forcibly displace the plate 80 from its first position, wherein the common vacuum passageway 72 is placed in open communication with the first vacuum chamber 64, upwardly to its second position, the plate 80 is attached, by means of the pull cable 94, to a solenoid which can be electrically actuated. More particularly, the pull cable 94 extends upwardly and outwardly from the valve housing 82 to a first roller cable guide 112, and from there the distal end of the pull cable is attached to an actuator arm of the solenoid. When the solenoid is not actuated, the arm thereof is extended, permitting the springs 108 to pull the slidable plate 80 downwardly into its first position. However, when the solenoid is actuated, the actuator arm is drawn within the solenoid which, through the pull cable 94, draws the slidable plate 80 upwardly through the valve housing 82 into its second position to place the common vacuum passageway 72 into open fluid communication with the second vacuum chamber 68. Of course the solenoid can be deleted and replaced with a manual pull cable handle and block, wherein the plate 80 position can be controlled manually.

The floating vacuum heads 52 and 54 are attached to the inner housing 42 in such a manner so as to permit the vacuum heads to move up and down as well tilt left to right. In this regard a pair of channel-like tracks 114 are affixed to the front and rear walls 48 and 50 of the inner housing 42 so as to position the respective floating vacuum head therebetween. Each floating vacuum head 52 and 54 includes a slider plate 116 disposed adjacent to a respective wall 48 or 50, which provides outwardly extending flanges 118 extending vertically substantially the length of the vacuum head 50 or 54.

Figure 5:
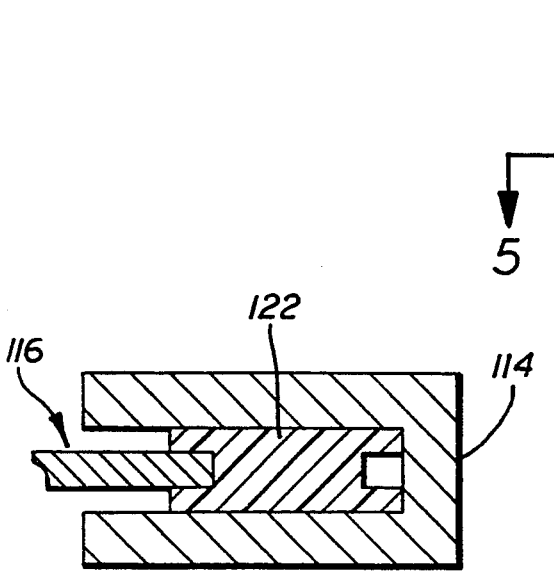
FIG. 5 is a partially fragmented sectional plan view taken generally along the line 5—5 of FIG. 4.
Figure 4:
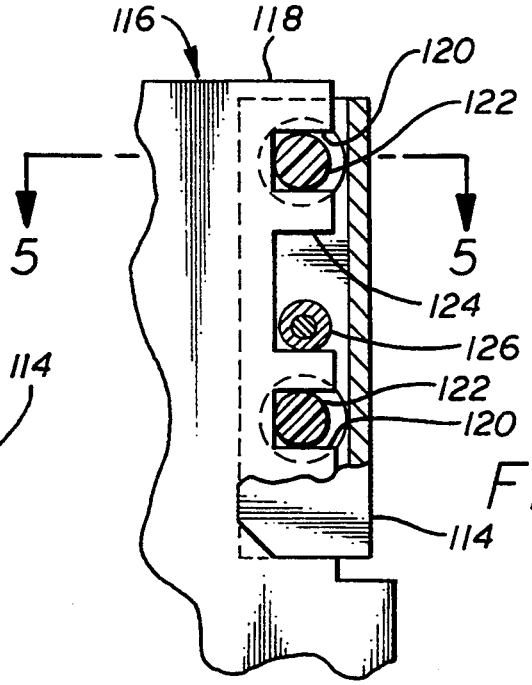
FIG. 4 is an enlarged fragmented partially sectional view taken generally along the line 4—4 of FIG. 3, illustrating the positioning of a flange of a floating vacuum head positioned within a track fixed to a stationary housing.

As shown best in FIGS. 3–5, each flange 118 is disposed within a respective track 114 in such a manner so as to permit the flanges 118 to move upwardly and downwardly therein. Each flange 118 includes a pair of recesses 120 which receive a self-lubricating glider 122, which serves to space the flange 118 from the respective track 114 to minimize frictional contact therebetween. Each flange 118 further includes a third recess 124 intermediate of the recesses 120 for the glider 122, through which a slide-limiting stop 126 extends. The stop 126 is fixed to the track 114 and extends generally across the channel formed therein. Engagement of the stop 126 with a side of the third recess 124 defines a limit on the vertical travel of the floating vacuum head relative to the track 114.

An upper bracket 128 is fixed to the slider plate 116 of the floating vacuum heads 52 and 54, and provides an anchor for an upper end of a spring 130. The lower end of the spring 130 is anchored into a lower bracket 132 which is fixed to the track 114. The spring 130 provides a biasing force tending to urge the floating vacuum head 52, 54 downwardly to place the inlet opening 22, 26 adjacent to the surface 18 to be cleaned.

As described more fully in U.S. Pat. No. 5,189,757, means are provided for controlling the brush drive motor so as to rotate the brush 16 in a direction as determined by the vacuum pathway selected and to assist in propulsion of the vacuum cleaning apparatus 12 over the surface 18 to be cleaned. As illustrated in FIG. 2, the brush 16 preferably rotates in a first direction as indicated by the arrows 134 to pull the vacuum cleaning apparatus 12 in a forwardly direction as debris loosened by the brush is vacuumed through the first inlet opening 22. As illustrated in FIG. 3, the brush 16 is preferably caused to rotate in an opposite direction as indicated by the arrows 136 so as to propel the vacuum cleaning apparatus 12 in a rearward direction when the vacuum is being drawn through the second vacuum pathway 24 and, thus, the second inlet opening 26. The inlet opening through which dirt, debris and the like is collected, follows the brush 16.

From the foregoing it is to be appreciated that the improved cleaning head assembly 10 for the vacuum cleaning apparatus 12 permits debris to be vacuumed from either side of the rotatable brush 16, as selected by the operator, and ensures that optimal cleaning efficiency is attained, even over irregular or bumpy surfaces 18 to be cleaned. The floating vacuum heads 52 and 54, which are supported within the tracks 114, move vertically relative to the inner housing 42 so as to optimally position the inlet openings 22 and 26 for maximum suction.

Although a particular embodiment of the invention has been described in detail for purposes of illustration, various modifications may be made without departing from the spirit and scope of the invention. For example, dual vacuum motors might be individually coupled to the dual vacuum heads in place of the gate valve 28 and the common vacuum passageway 72. Accordingly, the invention is not to be limited, except as by the appended claims.

We claim:

1. A floating head assembly for a vacuum cleaning apparatus, comprising:

a stationary support within the vacuum cleaning apparatus;

dual, independently floating vacuum heads adjacent to the stationary support, each having an inlet opening at one end thereof adjacent to a surface to be cleaned, and an outlet opening spaced from the inlet opening, the vacuum heads defining a portion of respective vacuum pathways extending from the respective inlet opening to a dirt collection zone within the vacuum cleaning apparatus; and means for attaching each vacuum head to the stationary support in a manner permitting relative movement therebetween.

2. A floating head assembly as set forth in claim 1, including a flexible hose coupled to one outlet opening and defining a portion of the respective vacuum pathway.

3. A floating head assembly as set forth in claim 1, wherein the stationary support includes a housing for a rotatably driven brush carried within and centrally spanning the vacuum cleaning apparatus adjacent to the surface to be cleaned, wherein the brush is adapted to loosen and agitate dirt on the surface to be cleaned.

4. A floating head assembly as set forth in claim 1, wherein the attaching means comprises a pair of generally vertically disposed tracks fixed to the stationary support on opposite sides of each vacuum head, wherein each track engages a respective one of a pair of generally vertically extending flanges extending from the vacuum head such that the flanges move within the tracks to permit movement of the vacuum head relative to the stationary support.

5. A floating head assembly as set forth in claim 4, wherein the attaching means includes means for facilitating movement of the flanges within the tracks.

6. A floating head assembly as set forth in claim 5, wherein the facilitating means includes a glider fixed with respect to a flange and which spaces the flange from the respective track to minimize frictional contact therebetween.

7. A floating head assembly as set forth in claim 4, including means for limiting relative movement between the vacuum heads and the tracks.

8. A floating head assembly as set forth in claim 7, wherein the limiting means includes a stop pin fixed to a track and disposed so as to fit within a channel-like groove of the respective flange.

9. A floating head assembly as set forth in claim 4, including means for biasing the vacuum heads downwardly to place the inlet openings adjacent to the surface to be cleaned.

10. A floating head assembly as set forth in claim 9, including a spring extending between brackets fixed to the respective vacuum head and to at least one of the tracks.

11. A cleaning head assembly for a vacuum cleaning apparatus, comprising:

a rotatably driven brush carried within and laterally spanning the head assembly, the brush being adapted to loosen and agitate dirt on a surface to be cleaned;

a first floating vacuum head vertically movable relative to a housing for the brush and defining a portion of a first vacuum pathway having a first inlet opening adjacent to the surface to be cleaned and laterally spanning the head assembly on one side of the brush, the first vacuum pathway extending from the first inlet opening to a dirt collection zone within the vacuum cleaning apparatus;

a second floating vacuum head vertically movable relative to the housing for the brush and defining a portion of a second vacuum pathway having a second inlet opening adjacent to the surface to be cleaned and laterally spanning the head assembly on a second, opposite, side of the brush relative to the first inlet opening, the second vacuum pathway extending from the second inlet opening to the dirt collection zone within the vacuum cleaning apparatus; and means for selectively drawing a vacuum through the first or the second vacuum pathways.

12. A cleaning head assembly as set forth in claim 11, wherein the floating vacuum heads each include means for attaching the vacuum head to the brush housing in a manner permitting movement of the vacuum head relative to the brush housing.

13. A cleaning head assembly as set forth in claim 12, wherein the attaching means comprises a track fixed to the brush housing which engages a generally vertically extending flange extending from the vacuum head such that the flange moves within the track to control movement of the vacuum head relative to the brush housing.

14. A cleaning head assembly as set forth in claim 13, wherein the attaching means includes means for facilitating movement of the flange within the track, wherein the facilitating means includes a roller fixed with respect to the flange and which spaces the flange from the track to minimize frictional contact therebetween.

15. A cleaning head assembly as set forth in claim 14, including means for limiting relative movement between the vacuum head and the track, wherein the limiting means includes a stop pin fixed to the track and disposed so as to fit within a channel-like groove of the flange.

16. A cleaning head assembly as set forth in claim 13, including means for biasing the vacuum head downwardly to place the inlet opening adjacent to the surface to be cleaned, the biasing means including a spring extending between brackets fixed to the vacuum head and to the track.

17. A cleaning head assembly as set forth in claim 11, including a first vacuum chamber extending through the cleaning head assembly from the first inlet opening to a first exhaust port, a second vacuum chamber extending through the cleaning head assembly from the second inlet opening to a second exhaust port, and a common vacuum passageway extending to the dirt collection zone, wherein the common vacuum passageway is connectable to the first and the second exhaust ports to, respectively, form a portion of the first and the second vacuum pathways.

18. A cleaning head assembly as set forth in claim 17, wherein at least one of the first or second vacuum chambers is defined by one of the first or second vacuum heads and a flexible hose extending from said vacuum head to a respective exhaust port.

19. A cleaning head assembly as set forth in claim 18, wherein the means for selectively drawing a vacuum through the first or the second vacuum pathways includes means for selectively placing the common vacuum passageway in fluid communication with one of the first or the second vacuum heads.

20. A cleaning head assembly as set forth in claim 19, including a valve for selectively coupling a proximal end of the common vacuum passageway to one of the first or the second exhaust ports, wherein the valve comprises a slidable gate valve.

21. A cleaning head assembly as set forth in claim 20, including means for controlling and changing the direction of brush rotation in accordance with the vacuum pathway selected, wherein the position of the gate valve determines the direction of brush rotation through the brush rotation controlling means.

22. A cleaning head assembly for a vacuum cleaning apparatus, comprising:

a rotatably driven brush carried within and laterally spanning the head assembly, the brush being adapted to loosen and agitate dirt on a surface to be cleaned;

a vacuum head defining a portion of a vacuum pathway, having an inlet opening adjacent to the surface to be cleaned and laterally spanning the head assembly on one side of the brush, the vacuum pathway extending from the inlet opening to a dirt collection zone within the vacuum cleaning apparatus; and means for attaching the vacuum head to a housing for the brush in a manner permitting free-floating movement of the vacuum head relative the brush housing, wherein the attaching means comprises a track fixed to the brush housing which engages a flange extending from the vacuum head such that the flange moves within the track to control movement of the vacuum head relative the brush housing.

23. A cleaning head assembly as set forth in claim 22, wherein the attaching means includes means for facilitating movement of the flange within the track, wherein the facilitating means includes a glider fixed with respect to the flange and which spaces the flange from the track to minimize frictional contact therebetween.

24. A cleaning head assembly as set forth in claim 22, including means for limiting relative movement between the vacuum head and the track, wherein the limiting means includes a stop pin fixed to the track and disposed so as to fit within a channel-like groove of the flange.

25. A cleaning head assembly as set forth in claim 22, including means for biasing the vacuum head downwardly to place the inlet opening adjacent to the surface to be cleaned, the biasing means including a spring extending between brackets fixed to the vacuum head and to the track.

26. A cleaning head assembly as set forth in claim 22, including a flexible hose coupled to the vacuum head and defining at least a portion of the vacuum pathway.

27. A cleaning head assembly as set forth in claim 22, wherein the vacuum head comprises a first floating vacuum head and a second floating vacuum head, wherein the first floating vacuum head is vertically movable, free-floating and self-aligning relative to the brush housing and defines a portion of a first vacuum pathway having a first inlet opening adjacent to the surface to be cleaned and laterally spanning the head assembly on one side of the brush, the first vacuum pathway extending from the first inlet opening to a dirt collection zone within the vacuum cleaning apparatus, and wherein the second floating vacuum head is vertically movable, free-floating and self-aligning relative to the housing for the brush and defines a portion of a second vacuum pathway having a second inlet opening adjacent to the surface to be cleaned and laterally spanning the head assembly on a second, opposite, side of the brush relative to the first inlet opening, the second vacuum pathway extending from the second inlet opening to the dirt collection zone within the vacuum cleaning apparatus.

28. A cleaning head assembly as set forth in claim 27, including a first vacuum chamber extending through the cleaning head assembly from the first inlet opening to a first exhaust port, and a second vacuum chamber extending through the cleaning head assembly from the second inlet opening to a second exhaust port, and a common vacuum passageway extending to the dirt collection zone, wherein the common vacuum passageway includes a flexible hose and is connectable to the first and the second exhaust ports to, respectively, form a portion of the first and the second vacuum pathways.

29. A cleaning head assembly as set forth in claim 28, wherein at least one of the first or second vacuum chambers is defined by one of the first or second vacuum heads and a flexible hose extending from said vacuum head to a respective exhaust port.

* * * * *

UNITED STATES PATENT AND TRADEMARK OFFICE

CERTIFICATE OF CORRECTION

PATENT NO. : 5,347,678

DATED : September 20, 1994

INVENTOR(S) : William H. Williams and Paul G. Jacobs

It is certified that error appears in the above-identified patent and that said Letters Patent is hereby corrected as shown below:

In column 2, line 24, delete "of" and insert --or--.

In column 3, line 6, delete "heads" and insert --head--.

In column 3, line 65, delete "form" and insert --from--.

In column 4, line 36, delete "designed" and insert --designated--.

In column 4, line 37, delete "designed" and insert --designated--.

In column 6, line 62, delete "grove" and insert --groove--.

In column 7, line 39, after "well" insert --as--.

In column 10, line 67, after "relative" insert --to--.

In column 11, line 4, after "relative" insert --to--.

Signed and Sealed this

Twenty-fourth Day of January, 1995

*Attest:*

Bruce Lehman

BRUCE LEHMAN

*Attesting Officer*

*Commissioner of Patents and Trademarks*